US006133696A

United States Patent [19]

Tavares et al.

[11] Patent Number: 6,133,696

[45] Date of Patent: Oct. 17, 2000

[54] DIMMER FOR FLUORESCENT LIGHTING

[75] Inventors: Joao F. Tavares, 125 Sheridan Avenue, Apt. 207, Toronto, Ontario, Canada, M6K 2H4; Barna Szabados, Ancaster; Youssef H. Dableh, Mississauga, both of Canada

[73] Assignee: Joao F. Tavares, Toronto, Canada

[21] Appl. No.: 08/894,555

[22] PCT Filed: Jun. 2, 1997

[86] PCT No.: PCT/CA97/00079

§ 371 Date: Oct. 1, 1997

§ 102(e) Date: Oct. 1, 1997

[87] PCT Pub. No.: WO97/29618

PCT Pub. Date: Aug. 14, 1997

[30] Foreign Application Priority Data

Feb. 6, 1996 [CA] Canada ..... 2168941

[51] Int. Cl.[7] ..... G05F 1/00

[52] U.S. Cl. ..... 315/194; 315/DIG. 4; 315/209 R

[58] Field of Search ..... 315/209 R, 247, 315/224, 364, 105, 308, 307, 194, DIG. 4; 324/86

[56] References Cited

U.S. PATENT DOCUMENTS

| | | | |
|---|---|---|---|
| 3,264,518 | 8/1966 | Stauverman | 315/205 |
| 3,614,527 | 10/1971 | Wirtz | 315/DIG. 4 |
| 3,819,982 | 6/1974 | Nelson | 315/94 |
| 3,935,505 | 1/1976 | Spiteri | 315/DIG. 4 |
| 4,096,413 | 6/1978 | Alley | 315/276 |
| 4,172,981 | 10/1979 | Smith | 307/66 |
| 4,207,498 | 6/1980 | Spira et al. | 315/97 |
| 4,277,728 | 7/1981 | Stevens | 315/307 |
| 4,568,857 | 2/1986 | Head | 315/105 |
| 4,894,587 | 1/1990 | Jungreis et al. | 315/200 R |
| 4,928,038 | 5/1990 | Nerone | 315/209 R |
| 5,175,477 | 12/1992 | Grissom | 315/291 |
| 5,194,781 | 3/1993 | Konopka | 315/291 |
| 5,208,513 | 5/1993 | Murayama | 315/129 |
| 5,521,491 | 5/1996 | Najam | 324/86 |
| 5,578,908 | 11/1996 | Persson | 315/307 |
| 5,757,145 | 5/1998 | Johnson et al. | 315/308 |

FOREIGN PATENT DOCUMENTS

| | | |
|---|---|---|
| 0708579 | 4/1996 | European Pat. Off. . |
| 4421736 | 4/1996 | Germany . |
| 9215052 | 9/1992 | WIPO . |

*Primary Examiner*—Don Wong
*Assistant Examiner*—Tuyet T. Vo

[57] ABSTRACT

A dimmer applies a phase-controlled AC voltage to a lighting assembly which includes a fluorescent lamp operated with a magnetic ballast. A microprocessor performs a calibration routine in which the phase angle used in phase control is increment from 0 toward 180 degrees. The microprocessor monitors current conducted by the lighting assembly in response to each incrementing, effectively determining an operative range of phase angles free of flickering or drop-out. During steady-state operation, the microprocessor converts nominal power settings into corresponding phase angle settings within the operative range, preventing operation in undesirable states.

11 Claims, 6 Drawing Sheets

DIMMER FOR FLUORESCENT LIGHTING

TECHNICAL FIELD

The invention relates to dimmers for fluorescent lighting, and more specifically, to dimmers that operate with conventional magnetic ballasts and apply phase control to an AC voltage to vary power consumption.

BACKGROUND ART

A variety of dimmers for fluorescent lighting have been proposed. Examples can be found in U.S. Pat. Nos. U.S. Pat. No. 3,264,518 to Stauverman, U.S. Pat. No. 3,614,527 to Wirtz, U.S. Pat. No. 3,819,982 to Nelson, U.S. Pat. No. 3,935,505 to Spiteri, U.S. Pat. No. 4,096,413 to Alley, U.S. Pat. No. 4,172,981 to Smith, U.S. Pat. No. 4,207,498 to Spira et al, U.S. Pat. No. 4,277,728 to Stevens, U.S. Pat. No. 4,894,587 to Jungreis et al, U.S. Pat. No. 4,928,038 to Nerone, U.S. Pat. No. 5,175,477 to Grissom, U.S. Pat. No. 5,194,781 to Konopka and U.S. Pat. No. 5,208,513 to Murayama.

Although various dimmers have been proposed, prior art dimmers fall into two principal categories: electronic ballasts adapted to apply a continuous AC voltage of variable amplitude to a fluorescent lamp; and dimmers that apply phase control to the AC line voltage used to power a fixture and operate with magnetic ballasts. Electronic ballasts can operate fluorescent lamps at very low power levels for extended periods of time with no apparent damage to the lamps. However, retrofitting existing fluorescent fixtures can be very costly.

Dimmers that apply phase control can be conveniently connected to fluorescent light fixtures operating with a magnetic ballast. Such dimmers typically involve a controllable switch (often a triac or paired silicon controlled rectifiers) in series with the fixture, a potentiometer or other device permitting a user to specify a desired phase angle (power setting), and a triggering circuit that actuates the switch in each half-cycle of the applied AC voltage at the specified phase angle. The terms "phase control" and "applying phase control to an AC voltage" as used in this specification should be understood as controlling conduction in response to an AC voltage so that conduction occurs in each half-cycle of the AC voltage only after a particular phase angle. Terms indicating application of more or less phase control to an AC voltage should be understood as increasing or decreasing the phase angle used for phase control respectively to decrease or increase power consumption. The term "no phase control" should be understood as applying the AC voltage with a 0 phase angle.

There are several problems associated with using phase control to vary power consumption of a conventional fluorescent fixture. A fluorescent lamp is inherently a pulsating device but persistence in human vision gives the appearance of constant illumination. In a range of power settings between 70% and 90% of maximum power, however, a fixture is subject to flickering. The terms "flicker" and "flickering" as used in this specification should be understood as pulsing of light, perceptible to the human eye. The inventors' experimentation has indicated that flickering is most likely to occur between 80% and 85% power settings (lower phase angles). In a range of power settings that typically occurs below a 50% setting (larger phase angles), the fluorescent lamp turns gray and becomes progressively darker with increasing phase control. The inventors have identified that continued operation in a gray state results in a very rapid bum-out of the lamp, and that a lamp can fail in as little as 48 hours depending on exact power settings. These effects depends very much on the nature of the ballast, the nature of the lamps, and aging of the components. The range of power settings subject to flickering appears to expand with age, and the power setting at which a gray state occurs appears to increase with age. Ambient temperatures appears also to affect such conditions.

DISCLOSURE OF THE INVENTION

In one aspect, the invention provides a dimmer adapted to apply an AC voltage to a lighting assembly comprising a fluorescent lamp and a magnetic ballast. The dimmer comprises setting means for specifying nominal power settings for the lighting assembly, and control means for applying phase control to the applied voltage in each half-cycle of the applied voltage. The invention is more specifically characterized in that the control means comprise sensing means for sensing current conducted by the assembly in response to the applied voltage, and processor means responsive to the sensing means and to the setting means for specifying phase angles for phase control of the applied voltage. The processor means comprising a calibration mode of operation in which the processor means specify different phase angles for phase control of the applied voltage and monitor the current at each of the specified phase angle to determine an operative range of phase angles, that is phase angles that do not result in flickering or drop-out. The process means comprise a steady-state mode of operation in which the processor means convert nominal power settings into corresponding phase angles within the operative range, the control means specifying such corresponding phase angles for phase control of the voltage. The invention tends to avoid operation of the lighting assembly in states that damage the lamp or ballast.

Various aspects of the invention have been briefly summarized above. Others will be more apparent from the description below of an preferred implementation and will be more specifically defined in the appended claims.

BRIEF DESCRIPTION OF THE DRAWINGS

The invention will be better understood with reference to drawings in which.

BEST MODE OF CARRYING OUT THE INVENTION

Figure 1:
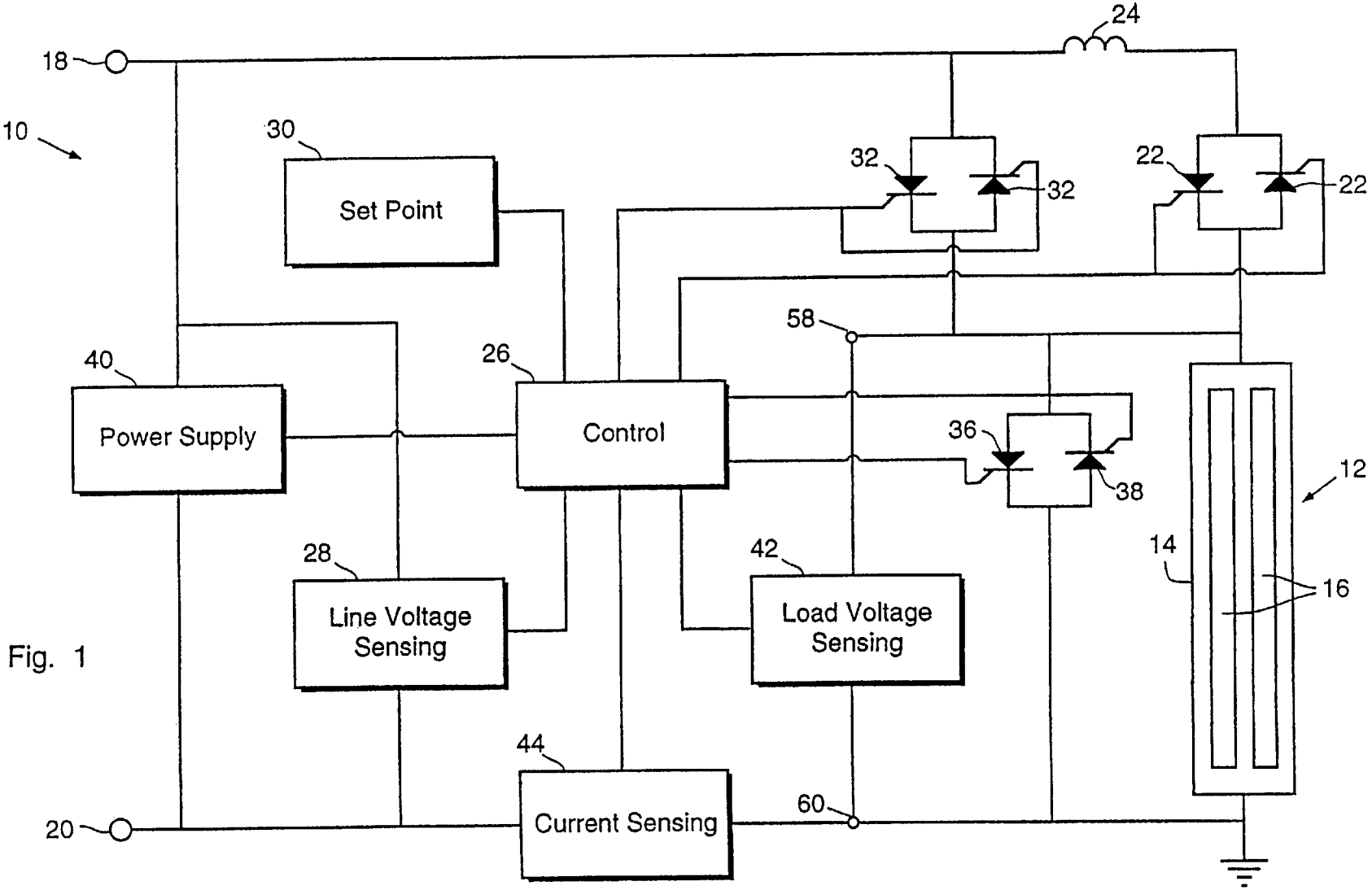
FIG. 1 is a schematic representation of a dimmer coupled to a fixture comprising a pair of fluorescent lamps and saturable magnetic ballast.

Reference is made to FIG. 1 which schematically illustrates a dimmer 10 coupled to a lighting assembly 12 comprising a magnetic ballast 14 and a pair of fluorescent lamps 16. It should be understood, however, that the assembly 12 might comprise multiple lamps and multiple ballasts. The dimmer 10 comprises live and neutral terminals 18, 20 which receives an AC line voltage, which might nominally be 120 volts RMS. The AC voltage is applied to the assembly 12 through a main pair 22 of silicon controlled rectifiers ("SCR's"), which are connected in parallel and oriented to conduct current in opposite directions, and an inductor 24 connected in series with the main pair of SCR's 22. A control block 26 actuates the main SCR's 22 to apply phase control to the AC voltage in response to a line voltage sensing block 28 that serves, among other things, to identify zero crossovers of the line voltage, and in response to a set point block 30 that specifies a nominal power setting for phase control. The set point block 30 may contain a potentiometer that allows a user to specify a desired power setting in a manner conventional to phase control. However, the set point block 30 may be eliminated, and a desired power setting may be specified by a central computer programmed to control lighting throughout a building.

The control block 26 also operates an auxiliary pair of SCR's 32 that by-pass the inductor 24 and main SCR's 22. The control block 26 actuates the auxiliary SCR's 32 in two circumstances: first, when the nominal power setting is 100% (0 phase angle) to reduce power losses; second, after a power failure or lamp drop-out. The AC line voltage is then applied to the lighting assembly 12 with the inductor 24 effectively short-circuited and with no phase control to ensure proper firing of the lamps 16. Another pair of SCR's 36, 38 shunt the lighting assembly 12, effectively defining a discharge current path between opposing ends of the lamps 16 for purposes of discharging capacitive voltages. The shunt SCR's 36, 38 are connected in parallel and oriented to conduct in opposite directions. The shunt SCR's 36, 38 are selected to have a holding current lower than that of the main SCR's 22 or the auxiliary SCR's 32 to ensure that the shunt SCR's 36, 38 are capable of conducting current when conduction by the main SCR's 22 or the auxiliary SCR's 32 extinguishes in response to low load current. The control block 26 triggers the shunt SCR's 36, 38 separately from one another in response to the line voltage sensing block 28 (specifically in response to the polarity of the line voltage), a load voltage sensing block 42 (specifically in response to the polarity of the voltage across the assembly 12) and in response to a current sensing block 44 (specifically in response to zero load current). The SCR 36 is identified below as the "positive-current SCR", and the SCR 38 is identified as the "negative-current SCR", indicating the direction in which each conducts current, assuming that current flow downward in the view of FIG. 1 is positive. A power supply 40 operating from the AC line voltage supplies power to the control block 26 and other components.

Figure 3:
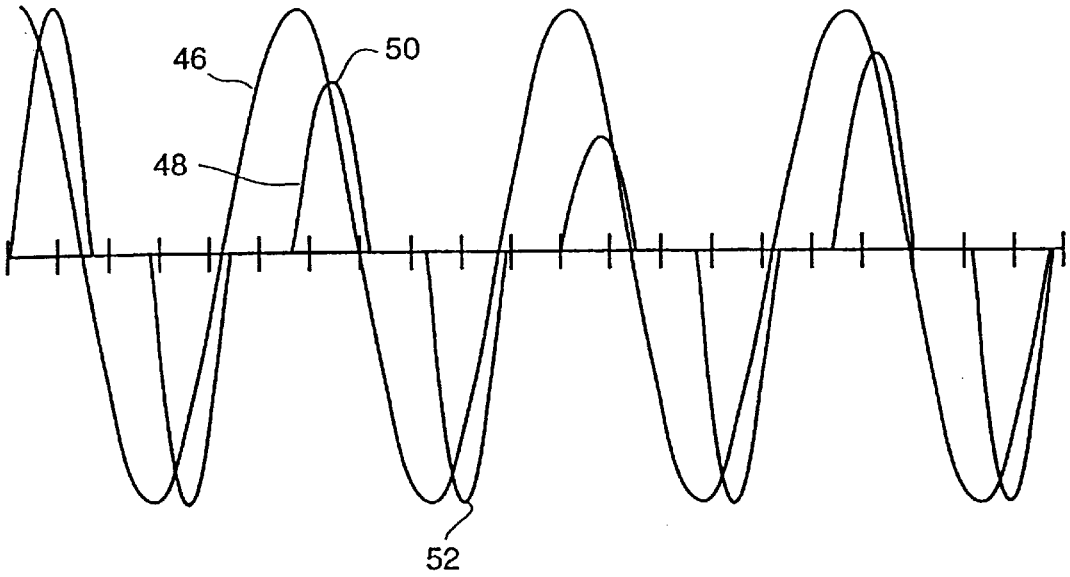
FIG. 3 shows a graph derived from oscilloscope traces of current flow in relation to line voltage in the fixture that is flickering.

The assembly 12 is subject to problems that a conventional magnetic ballast and fluorescent lamps experience in response to phase control of an applied AC voltage. In a new assembly, flickering may be expected in relatively narrow lower range of phase angles corresponding to a narrow range of power settings somewhere between 85% and 70%. In experiments, it has been noted that flickering is accompanied by an increase in load current, often beyond current drawn at the 100% power setting, and that the ballast tends to overheat during flickering. It has been discovered that such flickering is apparent in the waveform of the load current. An exemplary waveform is illustrated in FIG. 3, where both AC line voltage 46 and current 48 have been shown as a function of time. It should be noted that there is a DC offset in the load current 48, which is characteristic of flickering. In particular, peak current in positive half-cycles (as at 50) is markedly smaller than peak current in negative half-cycles (as at 52). This phenomenon is not, however, restricted to a particular polarity but periodically affects current in either positive or negative cycles of the line voltage. It should be noted that such a DC offset can be detected in the current before flicker becomes perceptible to the human eye.

The inductor 24 substantially eliminates flickering in the high-power range. For a single 34 watt lamps 16 operated with a rapid start ballast 14, the appropriate inductance value might typically be 12 millihenries (MH). The optimum inductance value can be predicted to some degree from experience with various fixtures but should be empirically determined for any particular type of application. The optimum value appears to depend on the particular ballasts, the particular lamps, the number of such components, the age of the components, and ambient temperature. The following should assist in selecting inductor 24 values. For a pair of fluorescent lighting fixtures comprising four 34 watt lamps of type F40CW operated with two rapid-start ballasts of type 17A240T, inductances of 8.2 millihenries, 12.7 millihenries, 18.7 millihenries, 28.4 millihenries, 47.7 millihenries and 59.2 millihenries were placed in series with the parallel set of lighting fixtures. The fixtures were then operated at power settings ranging from 100% down to about 30% with different inductors. All inductance values reduced flickering, which occurred in the 70–85% power setting range. Flicker was substantially eliminated with nominal inductance values between 12.74 and 59.2 millihenries. Other factors may influence selection of the inductance value in any particular application. Larger inductance values tend to reduce generation of harmonics in the line voltage and load current. However, larger inductance values also introduce power losses and will induce premature drop-out, which is particularly critical if multiple fixtures are potentially operated from the dimmer 10.

Figure 4:
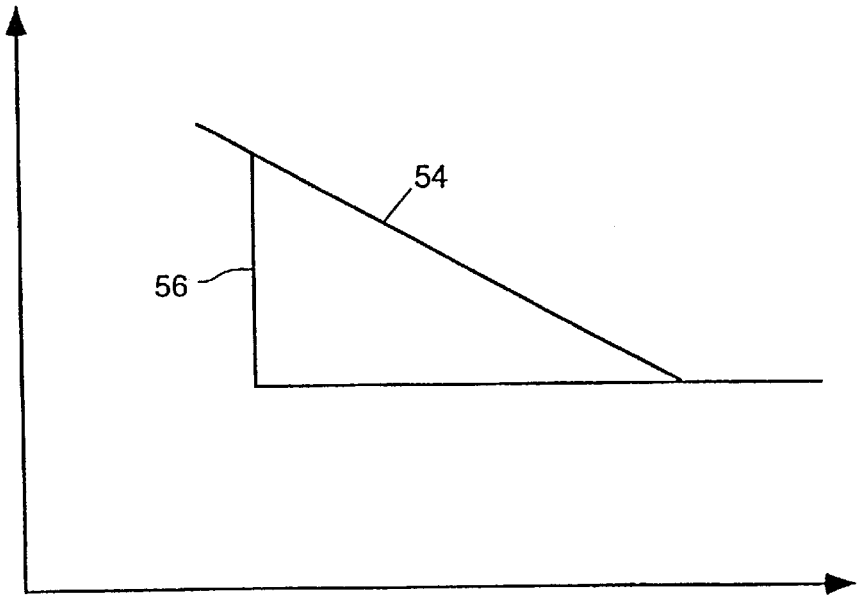
FIG. 4 diagrammatically illustrates the effect of an inductor on drop out of a fluorescent lamp.

Reference is made to FIG. 4 which qualitatively illustrates another effect of introducing the inductor 24 in series with the assembly 12. Phase angles from 90 degrees to 180 degrees are indicated along the horizontal axis, and current flow through the assembly 12 is indicated along the vertical axis. An upper curve 54 indicates changes in average current (RMS) through the fluorescent assembly 12 in response to progressively greater phase control, without a series inductor 24, while the lamps 16 are operating in a gray state. A lower curve 56 indicates changes in average current in response to progressively greater phase control, with the inductor in series with the assembly 12. As apparent form the curves, with the inductor in circuit, current drawn by the lamps 16 drops markedly and then remains relatively constant, rather than declining gradually. The sudden drop in current corresponds to a dropping out of the lamps 16. Drop-out appears less dependent on inductance values than suppression of flickering. In practice, an inductance value that tends to suppress flicker will also induce a sudden current drop indicating that a lamp is about to drop-out. Larger inductance values encourage drop-out at smaller phase angles and may potentially induce drop-out at phase values where the lamp might otherwise function adequately. In practice, tests should be performed to assess appropriate inductance values for any particular range of applications.

Figure 2:
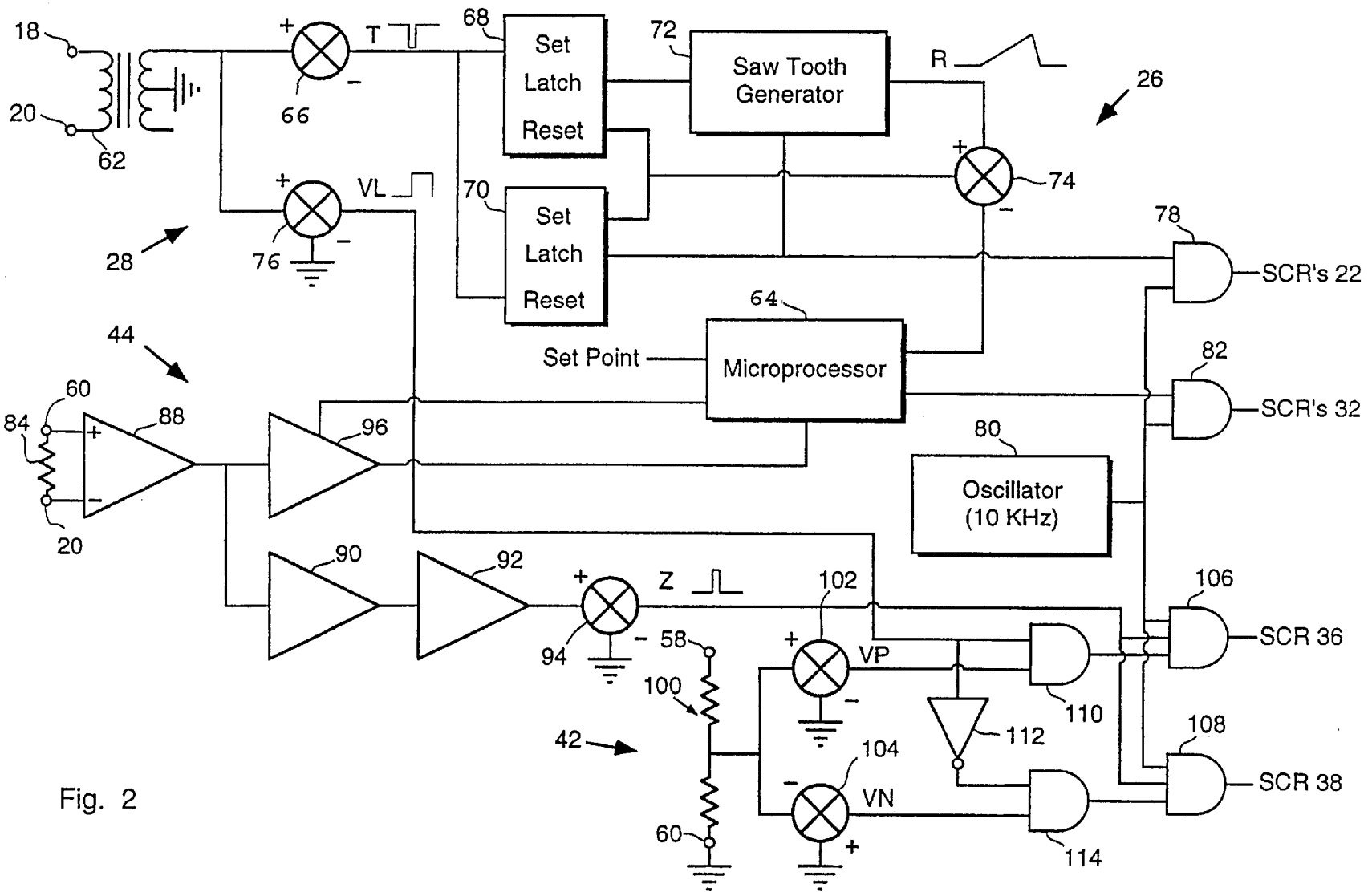
FIG. 2 schematically illustrates a control block and various sensing and signal processing blocks associated with the dimmer.

Reference is made to FIG. 2 which illustrates in greater detail the control block 26, the line voltage sensing block 28, the load voltage sensing block 42 and the current sensing block 44. Points 58, 60 where the load voltage sensing block 42 connects to other components of the circuit of FIG. 1 have been indicated with reference numerals 58, 60.

Phase control is implemented essentially with the following components. The line voltage sensing block 28 includes a step-down transformer 62 that reduces the AC line voltage, and a comparator 66 generates from the reduced AC voltage a triggering signal T (graphically indicated in FIG. 2) whose pulses are synchronized with zero crossovers of the line voltage. (The signal T is applied to a microprocessor 64 to synchronize its operation with the line voltage.) The triggering signal T sets one latch 68 and clears another latch 70. The set latch 68 actuates a saw tooth generator 72, which produces a ramp signal R (graphically indicated in FIG. 2). The microprocessor 64 produces a phase signal indicating a phase angle corresponding to the power setting specified by the set point block 30. A comparator 74 compares the ramp signal and the phase signal, and, when the ramp signal rises to the voltage of the phase signal, resets the one latch 68 and sets the other latch 70. This enables an AND gate 78 coupled through a conventional driver circuit (not illustrated) to the control terminals of the main SCR's 22, which effectively couples an oscillator 80 whose frequency is 10 kilohertz (KHz) to the control terminals of the main SCR's 22. Thus, in each half cycle of the AC line voltage, the main SCR's are actuated for conduction at a phase angle specified by the microprocessor 64.

Application of the AC voltage phase control to the assembly 12 results in considerable ringing in both load current and voltage. Such ringing will tend to extinguish conduction of the main SCR's 22 prematurely. The 10 kHz signal from the oscillator 80 addresses this problem. The main SCR's 22 are triggered periodically in each half-cycle of the line voltage, from occurrence of the phase angle specified by the microprocessor 64 substantially to the end of the half-cycle, when their conduction extinguishes with dropping load current. The frequency of the triggering signal should be "high" relative to the frequency of the applied AC voltage, commonly about 50–60 Hz, an order of magnitude difference or more being appropriate.

The microprocessor 64 actuates the auxiliary SCR's through another AND gate 82 coupled by a conventional driver circuit (not illustrated) to their control terminals. In response to specification of a 100% power setting or in response to a condition requiring restarting of the assembly 12 (as explained below), the microprocessor 64 applies a high value to the AND gate 82, effectively transmitting the high frequency signal generated by the oscillator 80 to the control terminals of the auxiliary SCR's. The auxiliary SCR's are then continuously triggered, effectively by-passing the inductor 24 and operating the assembly 12 with no phase control (0 phase angle).

The shunt SCR's 36, 38 are operated independently of the microprocessor 64. As mentioned above, the shunt SCR's are actuated in response to load current, the polarity of the load voltage, and the polarity of the line voltage. In that regard, the current sensing block 44 is adapted to produce a signal Z indicating when the load current is substantially zero (below the holding current of the main SCR's 22 or the auxiliary SCR's 32 and typically about 50 milliamperes.) It includes a low impedance, current sensing resistor 84 in series with the assembly 12 to produce a voltage signal corresponding in magnitude to the magnitude of the load current, but any other means for sensing the magnitude of load current can be used. A differential amplifier 88 amplifies the voltage signal, and a precision rectifier 90 produces a signal corresponding to the absolute value of the voltage signal. That signal is then scaled by a high gain amplifier 92, and a comparator 94 produces the signal Z, which has a high value when load current is substantially zero. The current sensing block 44 also includes a variable gain amplifier 96 coupled to the differential amplifier 88 to produce a current signal that is supplied to the microprocessor 64, which controls the gain of the amplifier 96.

The load voltage sensing block 42 includes a high-impedance resistive divider 100 that senses the voltages across the assembly 12. A pair of comparators 102, 104 are coupled to the resistive divider 100, the comparator 102 producing a signal VP which is high when the load voltage is positive, the other comparator 104 producing a signal VN which is high when the load voltage is negative, both signals VP and VN otherwise being low. A comparator 76 coupled to the transformer 62 produces a signal VL which is high when the line voltage is negative and otherwise low.

The shunt SCR's 36, 38 are controlled in response to the signals Z, VP, VN and VL by hard-wired logic circuitry. The oscillator 80 is used to supply a higher frequency triggering signal to the shunt SCR's 36, 38 for reasons outlined above. The high frequency signal and the zero current signal are applied to a pair of AND gates 106, 108 coupled through conventional driver circuits respectively to the control terminals of the shunt SCR's 36, 38. The positive load voltage signal VP and the load voltage polarity signal are applied to an AND gates 110 which controls the AND gates 106, and the negative load voltage signal VN and the inverse of the load voltage polarity signal produced by an inverter 112 are applied to another AND gate 114. The AND gate 106 thus actuates the positive-current SCR 36 in response to three conditions: substantially zero load current, a positive residual load voltage, and a negative line voltage. Similarly, the AND gate 108 actuates the negative-current SCR 36 in response to three conditions: substantially zero load current, a negative residual load voltage signal, and a positive line voltage. Thus, only one shunt SCR 36 or 38 is actuated depending on the polarity of the load voltage. The actuated shunt SCR 36 or 38 conducts only momentarily, turning off when discharge is complete. Triggering in response to the polarities of the load and line voltages ensures that the main SCR's 22 or the auxiliary SCR's 32 do not inadvertently shunt the power terminals 18, 20 through the SCR's 36, 38.

The microprocessor 64 stores various data regarding circuit operation. It monitors the load current through the sensing resistor 84 to detect the maximum current in each half-cycle of operation, storing peak positive and negative current values for the last 8 cycles of the line voltage. These values indicate presence or absence of a DC offset and consequently flickering. The microprocessor 64 also calculates an average current for the last 8 cycles of the line voltage, an RMS value or any other measure in which positive and negative half-cycles do not effectively cancel being appropriate.

Figure 5A:
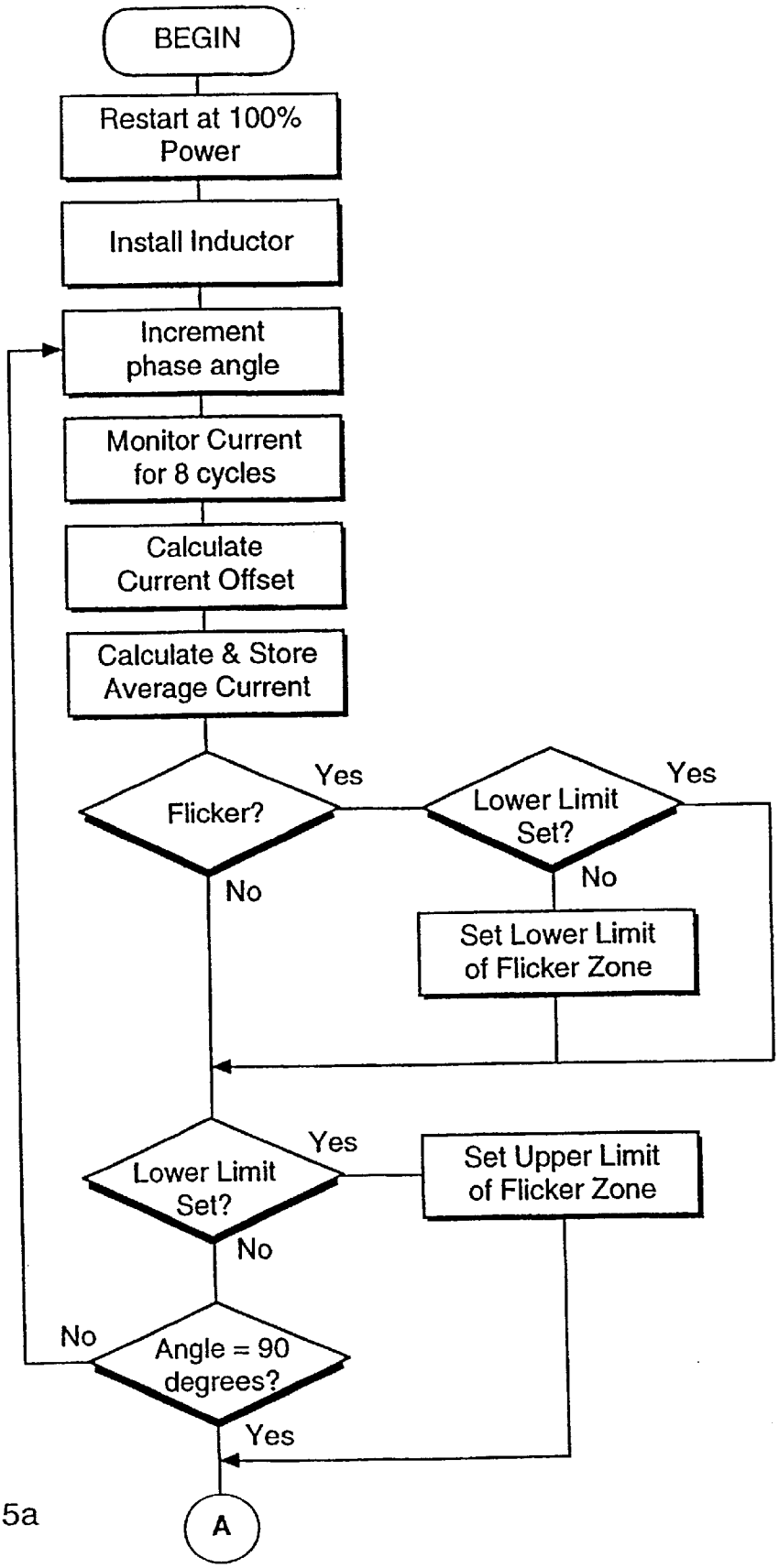
FIGS. 5*a* and 5*b* contain a flow chart illustrating a start-up procedure implemented by a microprocessor associated with the dimmer; and, FIG. 6 is a flow chart illustrating a steady-state operating procedure implemented by the microprocessor.
Figure 5B:
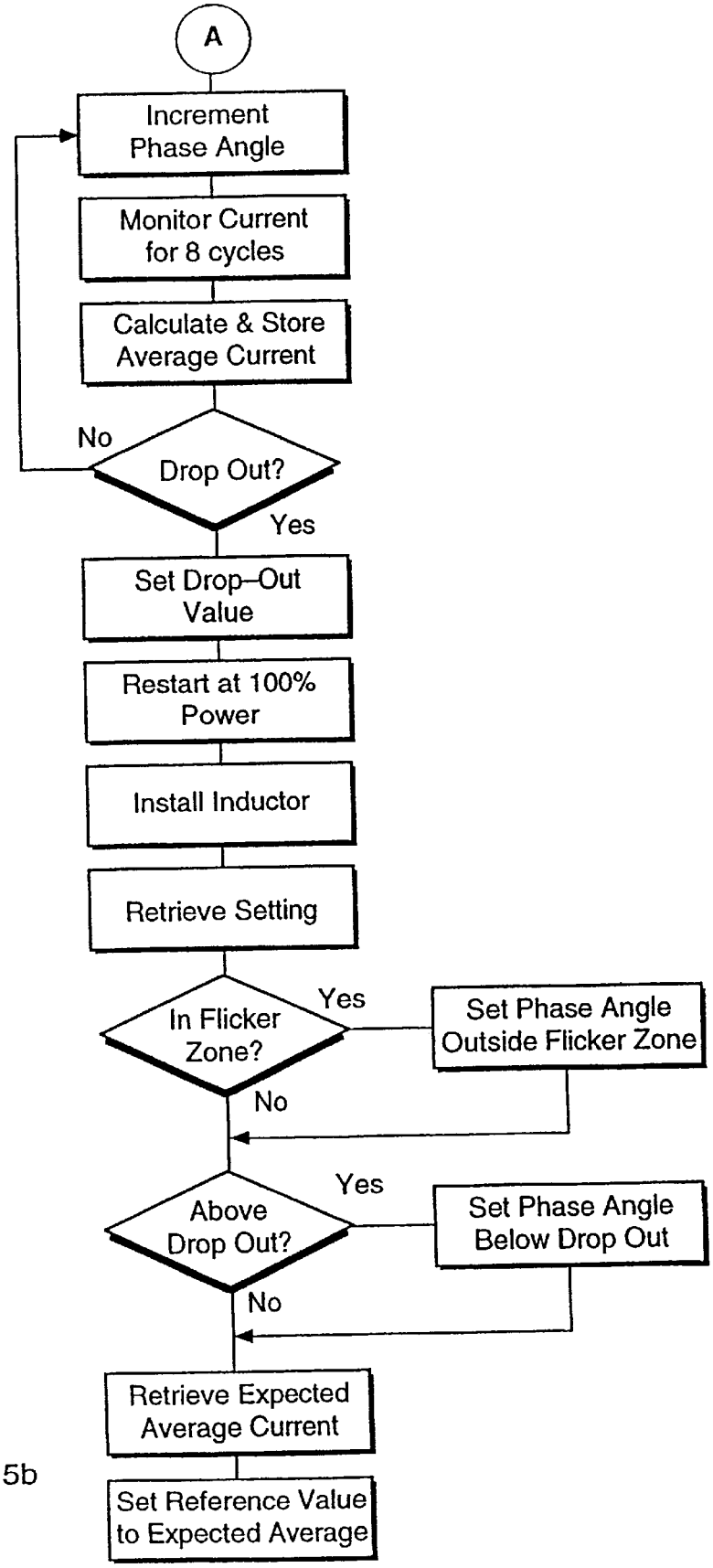

Reference is made to FIGS. 5*a* and 5*b* which illustrate a start-up calibration procedure implemented by the microprocessor 64. During the calibration mode of operation, the microprocessor 64 initiates a diagnostic procedure to determine the characteristics of the assembly 12. More specifically, the microprocessor 64 determines the location of a flicker zone, if not adequately suppressed by the inductor 24, which is expected in the 100% to 50% power range, corresponding roughly to phase angle of 0–90 degrees. It also determines a drop-out value, which is expected in the 50%–0% power range, corresponding roughly to phase angles of 90–180 degrees. In the flow chart of FIG. 5, the limits of the flicker zone and drop-out value are expressed in terms of phase angles, but such values can alternatively be expressed in terms of power settings.

The microprocessor 64 actuates the main SCR's 22, shunting the inductor 24 and restarting the assembly 12 at a 100% power setting (zero phase angle). The assembly 12 is operated with no phase control and no series inductor for roughly 7–10 seconds, allowing the lamps 16 to heat. The microprocessor 64 then disables the auxiliary SCR's 32 and enables the main SCR's 22, installing the inductor 24 in circuit with the assembly 12, and operating the main SCR's 22 with a 0 phase angle (no phase control). The microprocessor 64 then increments the phase angle used for phase control successively in one degree increments towards a phase angle value of 90 degrees. After each increment, the microprocessor 64 samples load current and records the maximum load current occurring in each half-cycle of operation for 8 complete cycles of the line voltage. The microprocessor 64 then examines the recorded values to determine if a current imbalance exists between alternate half-cycles (a DC current offset), indicating flicker. For example, a 20% difference in maximum current between two adjacent half-cycles (positive and negative) may be interpreted as flicker. Alternatively, average peak values in positive and in negative cycles may be subtracted to produce an average offset, which is preferably compared with average peak power, to assess whether a significant offset and thus flicker are present. When such a current imbalance is first detected, the microprocessor 64 records the relevant phase angle as the lower limit of the fixture's flicker zone. The incrementing of the phase angle is then continued until the current imbalance is no longer detected. The microprocessor 64 then records the relevant phase angle setting as the upper limit of the flicker zone. If the inductor 24 has suppressed any significant flicker, then no flicker zone is identified.

The microprocessor 64 then continues incrementing the phase angle setting to identify a drop-out value. After each increment, the microprocessor 64 samples the load current for 8 cycles, and calculates and stores the average magnitude of the current at the particular phase angle. The microprocessor 64 then compares the newly calculated average with the average current recorded for last phase angle setting to determine whether either of the lamps 16 has dropped out. In a typical application, multiple lamps will be operated simultaneously by the dimmer 10. Where N lamps are operated, a lamps 16 is assumed to have dropped out if the drop in average currents between two increments exceeds the last average current scaled by a factor of 1/N. Once the drop-out has been detected, the microprocessor 64 stores the relevant phase angle as the drop-out value for the assembly 12. Such an approach requires that the microprocessor 64 be apprised of the number of lamps, and such information may be supplied with a manual switch associated with the dimmer 10 or by a central computer where fixtures throughout a building are controlled by several comparable dimmers. Alternatively, the microprocessor 64 can calculate the average change in current between increments, and compare the drop in current with the average change. Except where an very large number of lamps are operated simultaneously, the average change in current between increments should be markedly smaller than the change occurring when a single lamp drops out.

Once the drop-out value has been determined, the microprocessor 64 initiates a full power restart of the assembly 12 with the inductor 24 by-passed (typically for about 3 seconds) to reheat the lamps 16. The nominal power setting specified by the user is then retrieved and converted into a nominal phase angle setting. If the nominal phase angle is within the flicker zone, the microprocessor 64 sets the actual phase angle used for phase control to a value outside the flicker zone. Different approaches can be taken to convert a nominal power setting into an appropriate phase angle within an operative range. For example, the phase angle may be set to the lower limit of the flicker zone less one degree or to the upper limit plus one degree depending on which adjusted value is closer to the nominal phase angle. Since steady state operation (described below) requires a reference value for average current in a last phase angle setting, the microprocessor 64 retrieves the value calculated and stored during the diagnostic procedure for the current phase angle setting. The diagnostic aspect of the start-up calibration procedure should be complete within 30 seconds and is not expected to cause any significant inconvenience.

Figure 6:
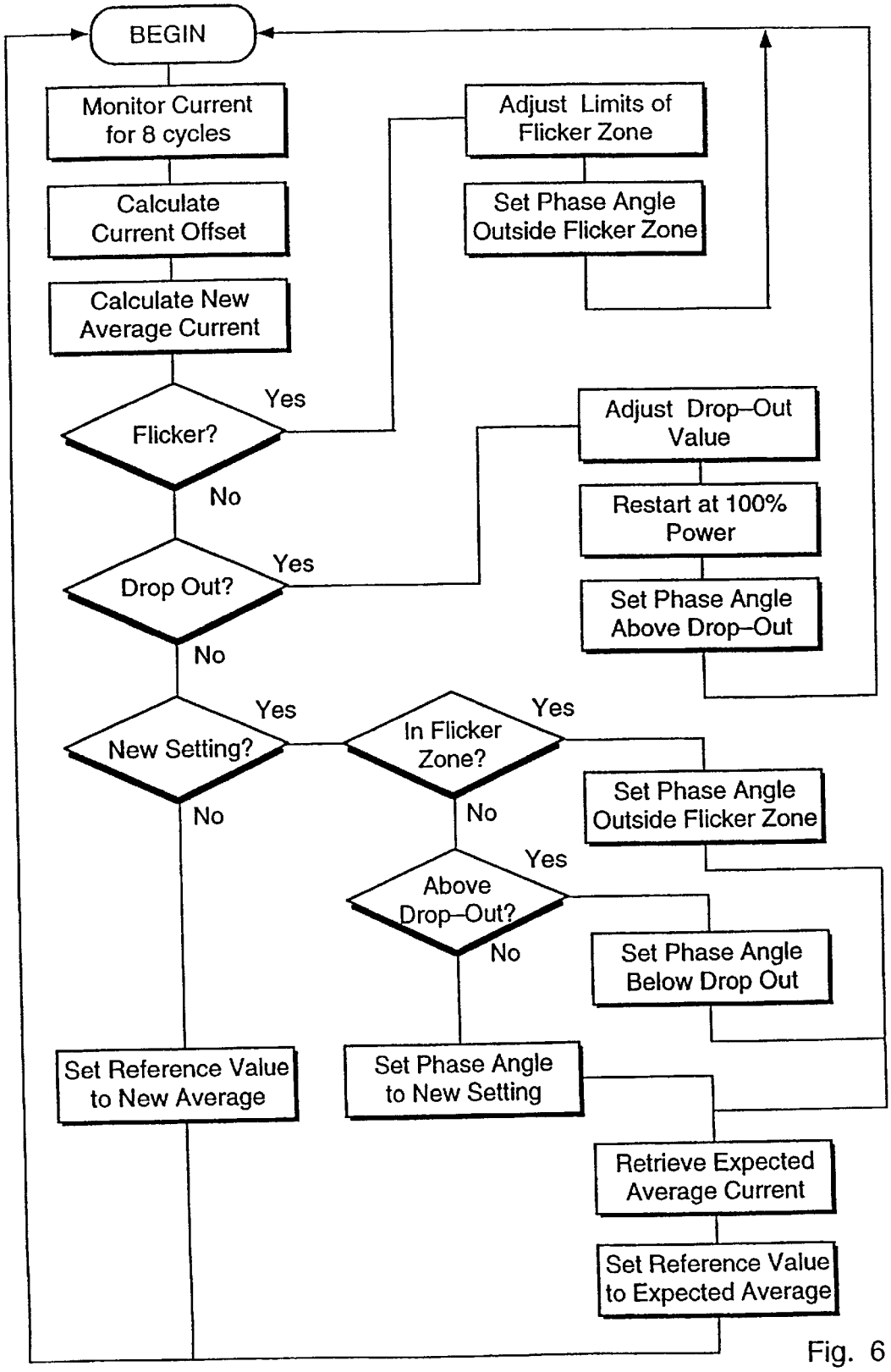

Steady state operation following start-up and calibration is illustrated in FIG. 6. The microprocessor 64 effectively cycles, monitoring load current and checking for different events: a DC offset in load current indicating flicker, and a drop in load current indicating a drop-out condition, and a user-specified setting change. The flicker zone and drop-out value can change during operation, particularly if lamps are continuously operated. In each cycle of its operation, the microprocessor 64 monitors load current for 8 cycles, calculates the DC offset in the load current, and the average value of the load current. If no event is detected, the microprocessor 64 simply records the newly calculated average as the reference value to be used for assessing whether a subsequent drop-out occurs.

If a DC offset is detected that indicates flicker, the microprocessor 64 adjusts the recorded limits of the flicker zone, expanding the recorded flicker zone to include the current phase angle. If a flicker zone was not recorded during start-up, the current phase angle may serve as the limits of the zone. The microprocessor 64 then adjusts the phase angle to a value outside the adjusted flicker zone. If the phase angle setting is above the originally recorded upper limit of the flicker zone, then the microprocessor 64 increases the actual phase angle by one degree, and otherwise decreases the phase angle by 1 degree. The phase angle used for phase control and the limits of the flicker zone may be further adjusted in successive cycles of processor operation until flickering is eliminated. Since the phase angle is change by only one degree, the reference value used for drop-out detection need not be updated to the newly calculated average value.

If the average current at any cycle of processor operation is markedly lower than the reference value recorded in the immediately preceding cycle, a drop-out condition is assumed. The microprocessor 64 then restarts the assembly 12 with the inductor 24 shorted and no phase control for a period of roughly 3 seconds to warm the lamps 16. The microprocessor 64 adjusts its recorded drop-out value by subtracting 1 degree, re-installs the inductor 24, and then sets the phase angle to the new drop-out value less 1 degree. The reference value for drop-out calculation is left unchanged. Such steps may be repeated in subsequent processor cycles until a phase angle setting is achieved that keeps the assembly 12 free of drop-out.

If no flicker or drop-out has been detected, the microprocessor 64 checks for a user setting change. If a change has occurred, the microprocessor 64 converts the new power setting to a corresponding nominal phase angle. If the phase angle is within the recorded flicker zone or below the record drop-out value, the nominal phase angle is adjusted before use in phase control, as described above. Since the new phase angle may be significantly larger or smaller than the previous phase angle, the expected average current for the new phase angle, recorded in the diagnostic procedure during start-up is retrieved and used as the reference value for assessing whether drop-out occurs in the next cycle of processor operation.

The start-up routine of the microprocessor 64 accommodates power failures. This is particularly important if the setting circuit 30 is manually operated. Once AC line voltage is restored, the power supply restarts the microprocessor 64, which launches its calibration procedure. The start-up procedure involves operating the assembly 12 for 7–10 seconds at a 100% power setting with the inductor 24 shunted, which accommodates any cooling of the lamps 16.

In the procedures described above, storing expected average current values during calibration permits an operating phase angle to be immediately changed while providing a reference value to assess whether the change results in drop-out of one or more lamps. An alternative approach involves implementing setting changes in small increments, such as one degree, so that current levels measured immediately before and after increments can be used to detect drop-out. Large phase angle changes may, however, require several seconds to implement, and passage through a flicker zone during transitions between phase angle settings may be necessary.

In the foregoing description, the microprocessor 64 relies solely on current measurement to detect lamp drop-out. The microprocessor 64 may be coupled to the load voltage sensing block 42 to monitor load voltage. Instead of calculating average current for 8 cycles of operation, the microprocessor 64 can calculate instantaneous power (instantaneous load current times instantaneous load voltage) and average power. During start-up, when determining the drop-out characteristic of an assembly, or during steady-state operation, when checking for occurrence of drop-out, average power values can be compared to determine whether a drop-out has occurred. Fluctuations in line voltage are often minor and slow so that differences in power consumption tend to correspond to differences in operating current. Fluctuations in line voltage can, however, be detected and used to compensate for apparent current or power drops that might otherwise suggest a drop-out condition.

Various modifications may be considered. The microprocessor 64 and appropriate software routines may provide various means otherwise implemented in circuit form. The microprocessor 64 receives the signal T identifying when zero crossovers of the line voltage occur in order to identify half-cycles and perform current calculations. With routine programming, the microprocessor 64 may calculate when a specified phase angle occurs in each half-cycle of the line voltage and may initiate triggering of the main SCR's 22. The microprocessor 64 may also control shunting of the assembly 12 in response to sampled voltage and current signals. If the diagnostic procedure and avoidance of unsuppressed flicker zones and drop-out is not required, the microprocessor 64 may be eliminated. In a dimmer which is not processor-based, the restart function for accommodating failure of the AC line voltage can be implemented with a timing circuit, such as a resistive-capacitive charging network. The network may charge in response to restoration of the AC line voltage and incidental actuation of the dimmer power supply, and may suppress phase angle control until charged to a predetermined voltage after an appropriate delay period. SCR's are preferred, but other devices such a power transistors may be used.

The foregoing description and the diagnostic and steady-state processes in the flow charts of FIGS. 5*a*, 5*b* and 6 have assumed presence of an inductive load. Several points should be noted. In a dimmer involving analog circuits, the inductive load is important because it produces a readily detectable signal indicating a drop-out problem. However, the inductive load is in fact inducing a very rapid drop-out, which may require restarting. In a dimmer which relies primarily on a microprocessor, calculations can be performed to assess whether a drop-out condition is occurring, and the inductor is not required for such purposes. The microprocessor can respond to a detected drop-out condition by simply decreasing the phase angle in increments before a lamp actually drops out. With the inductor eliminated, dimming can be restricted to power levels below 70% to avoid the flicker zone. Such an approach is practical for energy saving purposes, eliminates components, simplifies operation, and is consequently preferred. If a fast microprocessor is provided, an inductor can be used to suppress flicker and the dimmer can recover from a drop-out condition without requiring high power restarting.

It will be appreciated that a particular implementation of the invention has been described and that modifications may be made, beyond those already suggested, without necessarily departing from the scope of the appended claims.

What is claimed is:

1. A dimmer adapted to apply an AC voltage to a lighting assembly comprising a fluorescent lamp and a magnetic ballast, the dimmer comprising setting means for specifying nominal power settings for the lighting assembly and control means for applying phase control to an applied voltage in each half-cycle of the applied voltage, characterized in that the control means comprise:

sensing means for sensing current conducted by the assembly in response to the applied voltage; and processor means responsive to the sensing means and to the setting means for specifying phase angles for phase control of the applied voltage, the processor means comprising a calibration mode of operation in which the processor means specify different phase angles for phase control of the applied voltage and monitor the current at each of the specified phase angle to determine an operative range of phase angles and comprising a steady-state mode of operation in which the processor means convert nominal power settings specified with the setting means into corresponding phase angles within the operative range, the control means specifying such corresponding phase angles for phase control of the voltage.

2. The dimmer of claim 1 wherein said dimmer is adapted to respond to a failure and subsequent restoration of the AC voltage, in which the control means comprise means for:

applying the voltage with substantially zero phase control to the lighting assembly thereby to restart the lighting assembly, and after restarting of the lighting assembly, applying phase control to the voltage with a phase angle corresponding to the power setting specified by the setting means.

3. The dimmer of claim 1 in which the control means comprise switching means in series with the lighting assembly and an inductive load in series with the switching means, the inductance of the load being selected to attenuate the flickering of the lamp in response to phase control of the AC voltage at low phase angles.

4. The dimmer of claim 3 in which the control means comprise auxiliary switching means for by-passing the inductive load thereby to apply the AC voltage directly to the assembly, and the control means comprise a restart mode of operation in which the control means temporarily actuate the auxiliary switching means to by-pass the inductive load.

5. The dimmer of claim 1 adapted to discharge capacitive voltages developed in the lamp in response to phase control of the voltage, the control means comprising means for detecting zero cross-overs of the current flowing through the assembly and controllable shunt means for shunting the lamp thereby to allow discharge current flows in response to the capacitive voltages, the control means actuating the shunt means for momentary conduction of the discharge current flows at least at some of the detected zero cross-overs.

6. The dimmer of claim 5 in which:

the control means comprise means for detecting the polarity of the voltage and means for detecting the polarity of the voltage across the assembly; and, the control means actuate the controllable shunt means for conduction at each of the zero cross-overs only if the polarity of the voltage across the assembly at the zero cross-over is opposite to the polarity of the AC voltage.

7. The dimmer of claim 5 in which:

the shunt means comprise a pair of silicon controlled rectifiers in parallel and oriented such that each of the silicon controlled rectifiers conducts current in a different direction; and, the control means select one of the silicon controlled rectifiers for actuation at each of the detected zero cross-overs according to the polarity of the voltage across the assembly.

8. The dimmer of claim 1 in which the processor means are programmed to:

increment the phase angle during the calibration mode of operation progressively from about 0 degrees toward 90 degrees, monitor the current at each incrementing of the phase angle for presence of a DC offset thereby to detect a flicker zone associated with the lighting assembly, and to store a phase angle above the flicker zone to serve as a lower limit of the operative range.

9. The dimmer of claim 8 in which the processor means are programmed to monitor the current conducted by the assembly in the steady-state mode of operation to detect a DC offset corresponding to flickering of the lamp and to respond to such a detected DC offset by increasing the phase angle specified for phase control and increasing the stored phase angle corresponding to the lower limit of the operative range.

10. The dimmer of claim 8 in which the processor means are programmed to:

increment the phase angle toward 180 degrees during the calibration mode of operation, monitor the current at each incrementing of the phase angle to detect a phase angle which produces a current drop associated with drop-out of the lamp, and to store a phase angle corresponding to the detected phase angle to serve as an upper limit of the operative range.

11. The dimmer of claim 10 in which the processor means are programmed to monitor the current conducted by the assembly in the steady-state mode of operation to detect a current drop associated with drop-out of the lamp and to respond to such a detected current drop by reducing the phase angle specified for phase control and reducing the stored phase angle corresponding to the upper limit of the operative range.

* * * * *